US011745069B2

(12) United States Patent
Ashcraft

(10) Patent No.: US 11,745,069 B2
(45) Date of Patent: Sep. 5, 2023

(54) PUTTING PRACTICE DEVICE

(71) Applicant: William P. Ashcraft, Grosse Isle, MI (US)

(72) Inventor: William P. Ashcraft, Grosse Isle, MI (US)

( * ) Notice: Subject to any disclaimer, the term of this patent is extended or adjusted under 35 U.S.C. 154(b) by 113 days.

(21) Appl. No.: 17/353,007

(22) Filed: Jun. 21, 2021

(65) Prior Publication Data

US 2022/0401804 A1 Dec. 22, 2022

(51) Int. Cl.

| | |
|---|---|
| ***A63B 57/40*** | (2015.01) |
| ***A63B 47/00*** | (2006.01) |
| ***A63B 67/02*** | (2006.01) |
| ***A63B 69/36*** | (2006.01) |

(52) U.S. Cl.

CPC ..... *A63B 57/40* (2015.10); *A63B 47/00* (2013.01); *A63B 67/02* (2013.01); *A63B 69/3676* (2013.01)

(58) Field of Classification Search

CPC ..... A63B 47/00; A63B 57/40; A63B 57/357; A63B 67/02; A63B 69/3676

USPC ..... D21/790; 473/174

See application file for complete search history.

(56) References Cited

U.S. PATENT DOCUMENTS

| | | | | |
|---|---|---|---|---|
| 3,019,023 | A | 1/1962 | Westling | |
| 3,033,571 | A * | 5/1962 | Botts | A63F 7/305 273/127 D |
| 3,332,688 | A | 7/1967 | Gevertz | |
| 3,685,833 | A | 8/1972 | Jack, Jr. | |
| 3,810,632 | A | 5/1974 | Brandell | |
| 5,069,455 | A | 12/1991 | Thomas | |
| 5,087,046 | A * | 2/1992 | Mauch | A63B 67/02 206/315.9 |
| 5,431,403 | A | 7/1995 | Pelz | |
| 6,248,022 | B1 * | 6/2001 | Steyn | A63B 67/02 473/157 |
| 6,398,661 | B1 * | 6/2002 | Llewellyn | A63B 57/357 473/180 |
| 6,805,638 | B2 | 10/2004 | Chang | |

OTHER PUBLICATIONS

"The Rules of Golf for 2019", (C) 2018 R&A Rules Limited and the United States Golf Association, p. 141 (Year: 2018).*

* cited by examiner

*Primary Examiner* — Laura Davison

(74) *Attorney, Agent, or Firm* — Young Basile Hanlon & MacFarlane, P.C.

(57) ABSTRACT

A golf putting stroke practicing device includes a box-like housing designed to lie on any appropriate surface such as a carpeted floor wherein the front and bottom panels of the housing are provided with semi-circular/half-round cutouts that together create the realistic illusion of a regulation golf hole. The front of the housing is configured to deflect errant shots away from the hole opening. The device is easily carried and stored and can hold a number of regulation balls when not in use.

5 Claims, 9 Drawing Sheets

PUTTING PRACTICE DEVICE

TECHNICAL FIELD

The subject matter of this disclosure is in the field of golf practice devices. More particularly, this document describes a device that allows convenient and realistic practice of the putting stroke.

BACKGROUND

The putting stroke, a particularly important factor in improving one's success in the game of golf, can be practiced in a number of ways from simply hitting balls toward and hopefully into a glass lying on its side to stroking balls along a length of artificial grass that ramps up at the far end and provides a hole over a return mechanism. Neither provides realistic conditions that encourage practice and produce lasting improvement.

SUMMARY OF THE DISCLOSURE

The subject matter of this disclosure is a putting practice device which, in the illustrated embodiment, includes a box-like housing designed for convenient handling and use and which creates realistic putting conditions using conventional golf balls by creating the appearance of a regulation golf hole without requiring an elevated ramp or return mechanism. In addition, the disclosed embodiments provide further advantages that promote repeated usage including:

(a) the capacity to store a number of regulation golf balls; e.g., from 10 to 25;
(b) the ability to receive and store on target shots in which the ball goes through a hole opening;
(c) the ability to deflect errant shots away from the hole opening;
(d) the ability to be easily carried; and
(e) the ability to stand on end with the hole in the top panel thereby to conveniently store golf balls and the device between practice sessions both with and without a load of stored practice balls.

BRIEF DESCRIPTION OF THE DRAWINGS

The disclosure is best understood from the following detailed description when read in connection with the accompanying drawings. The drawings, although they are not full size, are to scale.

DETAILED DESCRIPTION OF THE ILLUSTRATIVE EMBODIMENT

Figure 1:
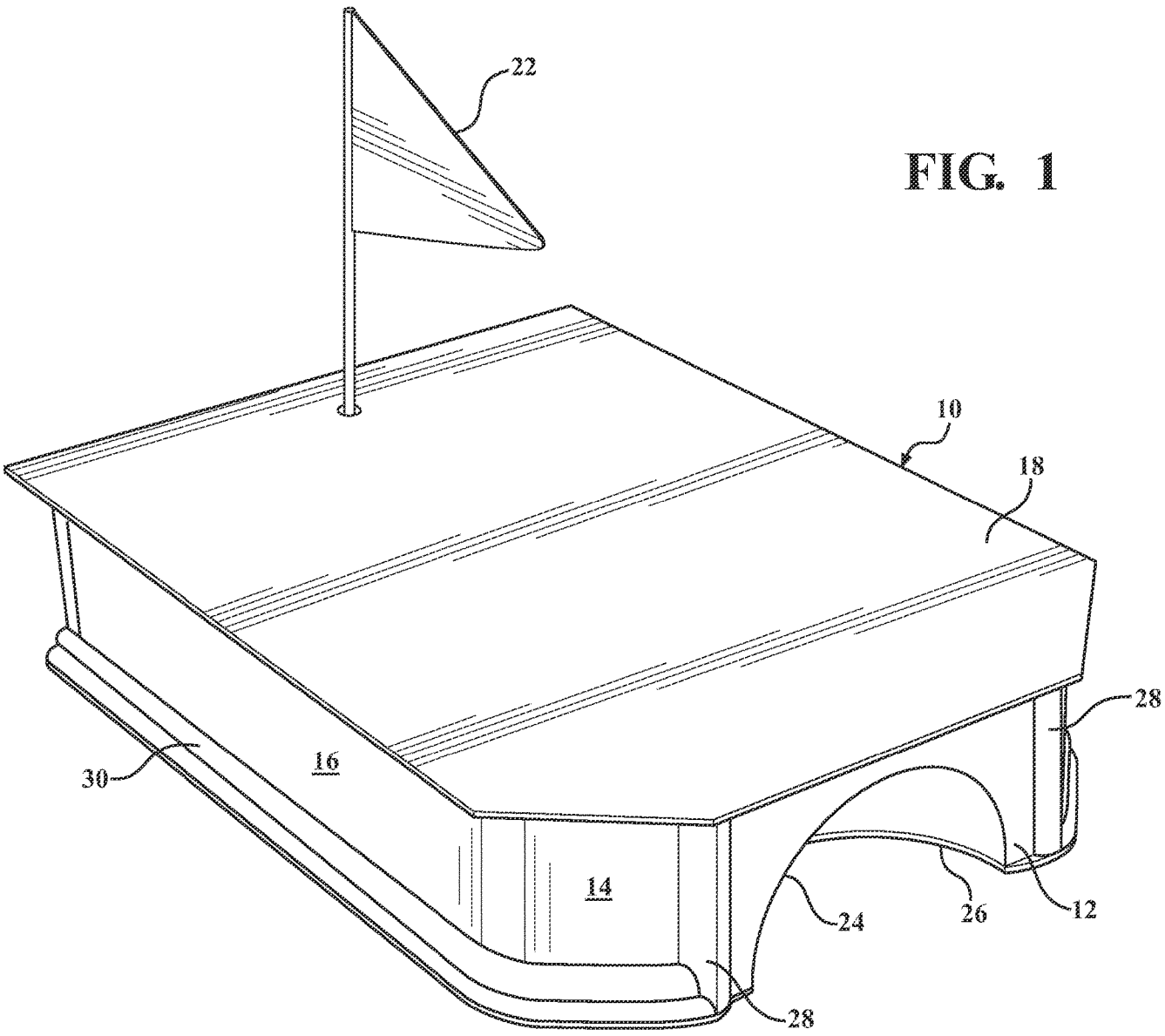
FIG. 1 is a perspective view of an illustrative embodiment.
Figure 2:
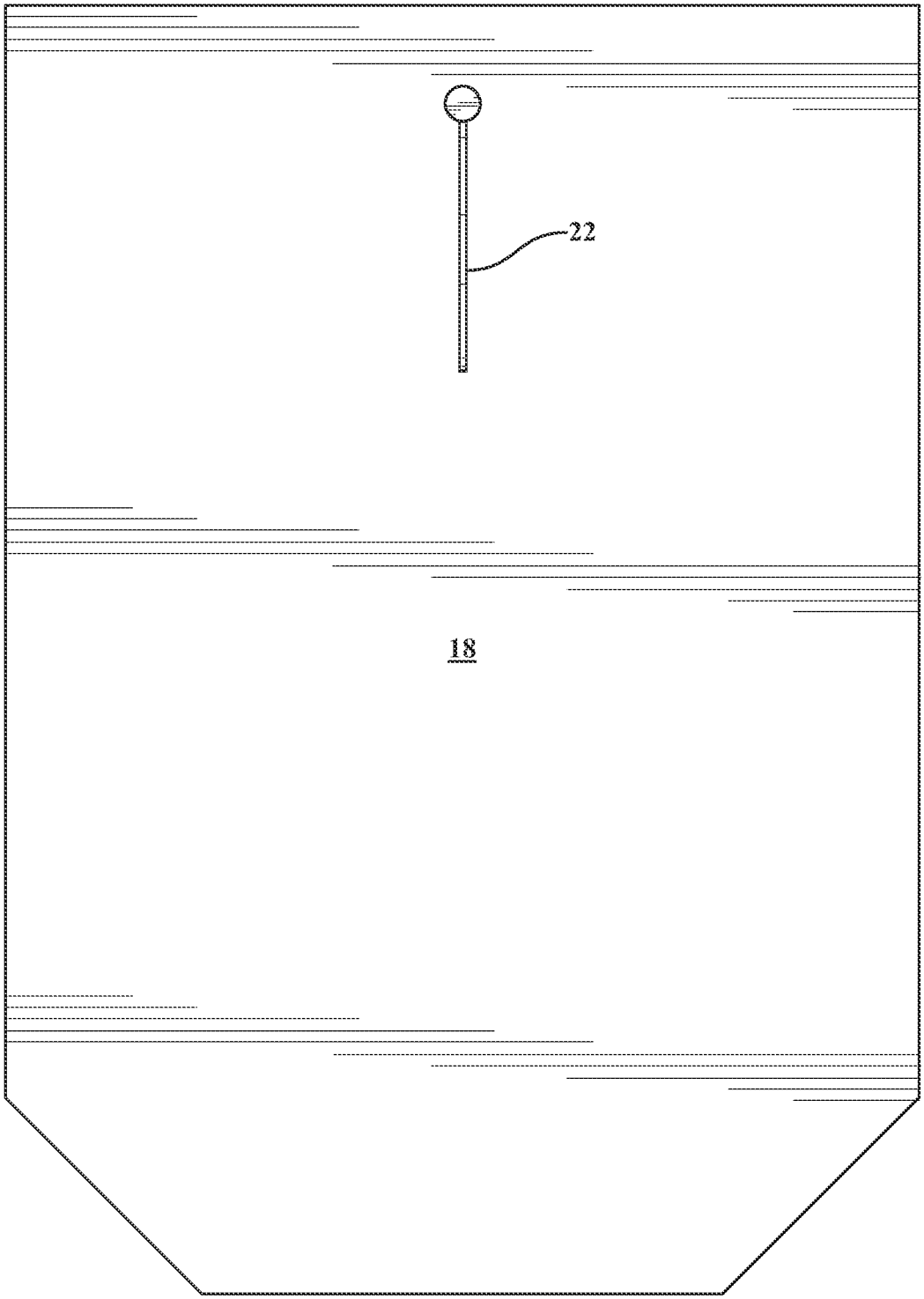
FIG. 2 is a top view of the FIG. 1 embodiment.
Figure 3:
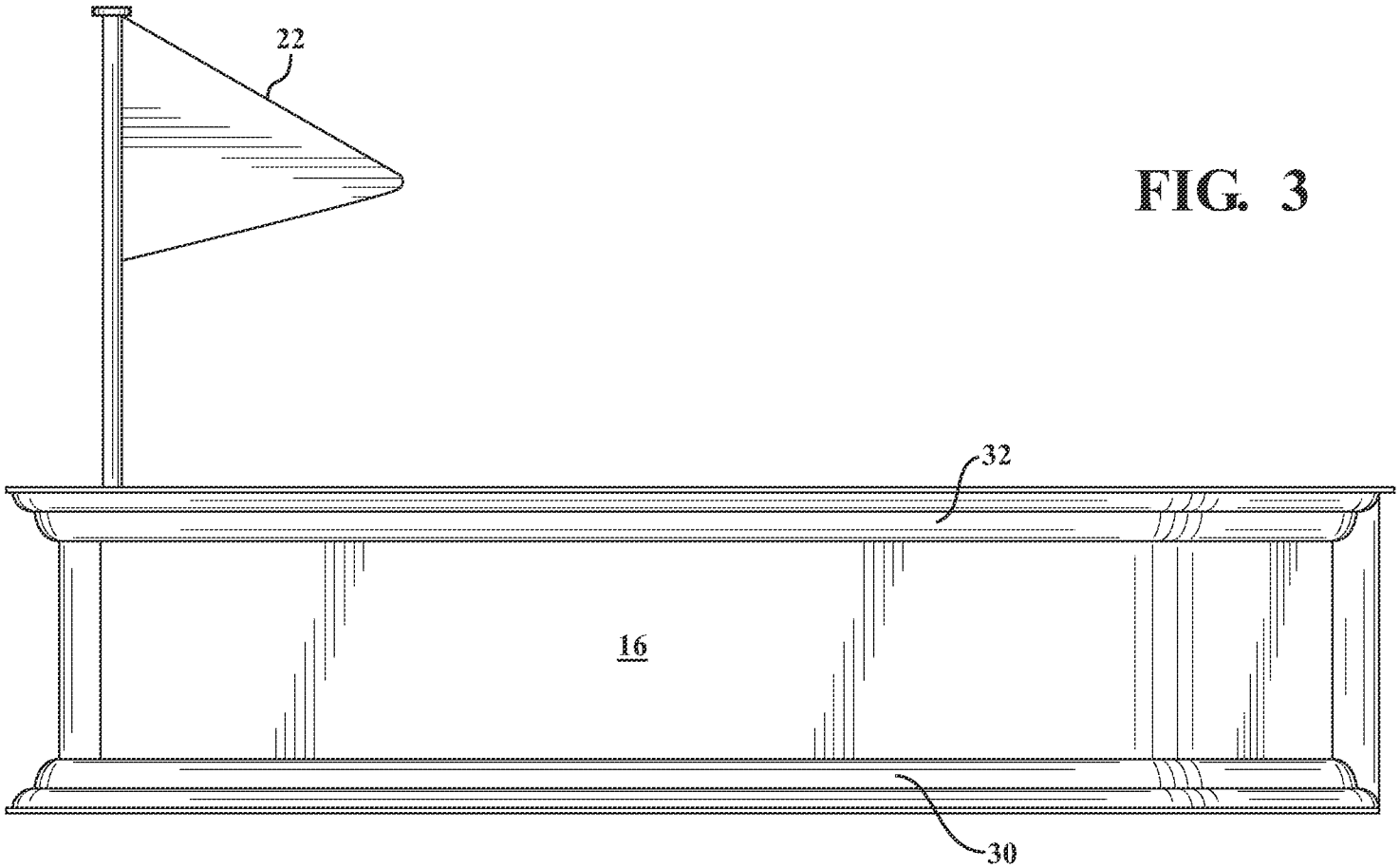
FIG. 3 is a left side view of the embodiment.

Referring now to the drawings and in particular the FIGS. 1-8, an illustrative and aesthetically novel embodiment of the device is shown to comprises a box-like housing 10 having a normally vertical front center panel 12, left and right front lateral panels 14, left and right side panels 16, a top panel 18, a bottom panel 20 and a vertical rear panel 21. All the panels are generally planar and may be made of a lightweight water-resistant sheet material. An interior frame of open box-like design may be used if necessary to add dimensional and shape stability to the housing 10. An optional and decorative miniature flag 22 is mounted on the rear area of the top panel 18

Continuing with the description of the illustrative embodiment, the front center panel 12 has centered within it a half-circular opening or "hole" 24 which, along the bottom edge has a diameter of exactly four inches, the same diameter as a regulation golf hole. The radius of the hole is, therefore, two inches. In a similar fashion the front edge of the bottom panel 20 has formed therein a second semi-circular opening 26 having a four inch diameter. The two half-hole openings 24 and 26 are aligned with one another by collocating their diameter lines so as to create the appearance and function of a regulation golf hole capable of receiving regulation size and weight golf balls and admitting them into the interior of the housing 10.

The left and right lateral panels 14 are essentially contiguous with the center panel 12 but are angled at 45° from the plane of the front panel 12 thereby to provide, along with other components to be described, deflection surfaces which turn errant shots; i.e. shots that do not cause the ball to go through the hole openings, away from the front of the housing 10 so that they do not get in the way of further practice shots.

The lateral panels 14 extend to and join the respective left and right side panels 16. The bottom panel 20, along with the rear and top panels 21 and 18, effectively closes the housing and creates a storage device for number of golf balls which can vary widely but a convenient number as far as weight and utility are concerned will be about 10 to 25.

Additional features comprise the vertical pillars 28 on the left and right sides of the front opening 24 providing deflection surfaces just outside of the hole opening 24, 26 to further assist in deflecting errant shots away from the front of the device. In addition, a bottom curb-like molding 30 runs along the bottom edge all of the way between the pillars 28 for strength and aesthetic purposes. A similar molding 32 is installed between the side, front, lateral and rear panels and the top panel all around the outside of the housing 10 for structural rigidity and aesthetic appeal. The moldings may be held in place by adhesive or conventional fasteners.

As indicated above the device may be made of lightweight water resistant or waterproof pre-colored panel material. The panels may be individually formed and pieced together of molded in various sub-assemblies as suits the preferences of the builder. A lightweight but rigid open box-like frame may be used within the housing 10 such that the housing panels are effectively built around the frame in order to be connected with one another using adhesives and threaded fasteners. It is preferred for durability that the device be dimensionally stable and not subject to flexing or warping due to temperature and/or humidity changes.

Figure 7:
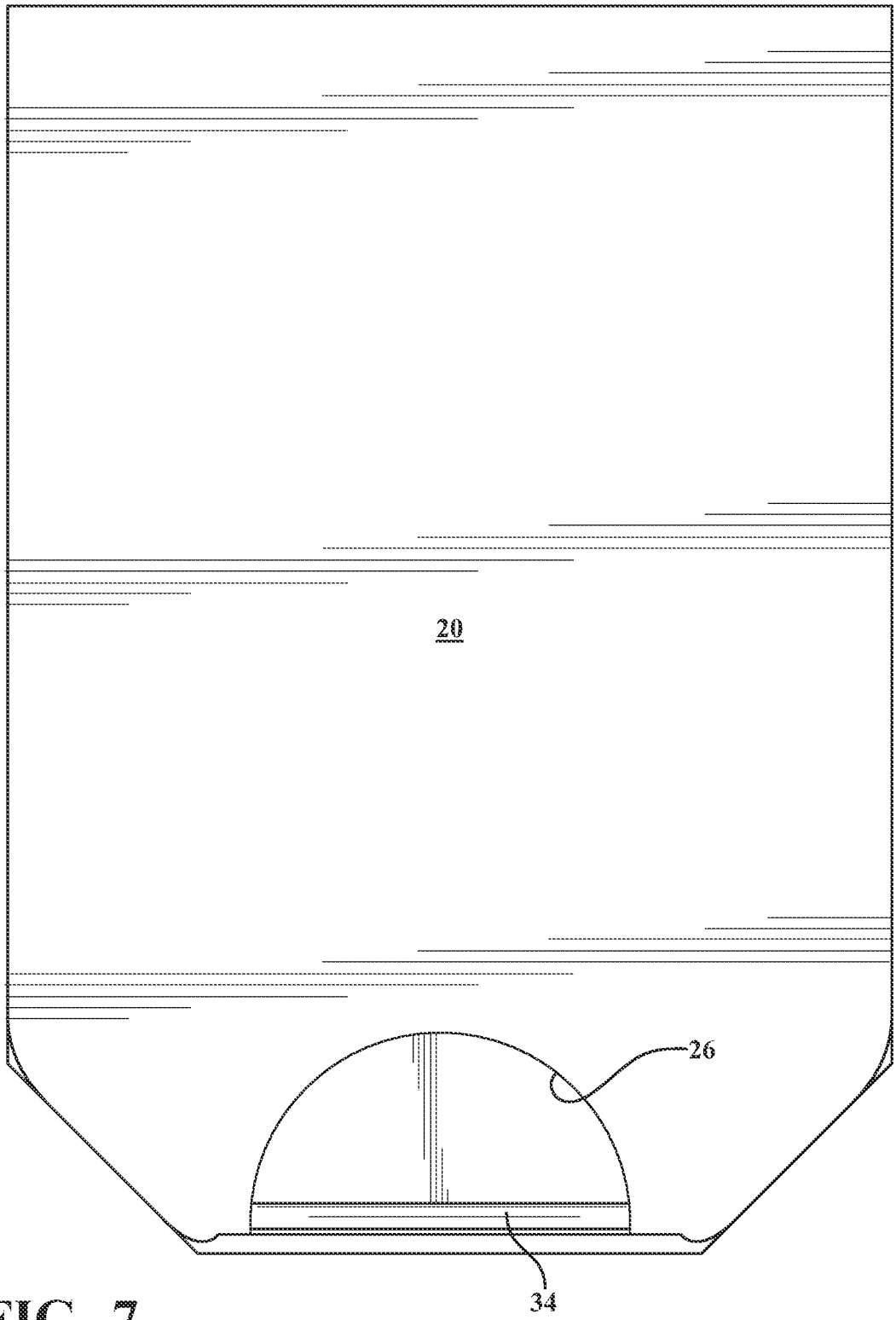
FIG. 7 is a bottom view of the embodiment.
Figure 8:
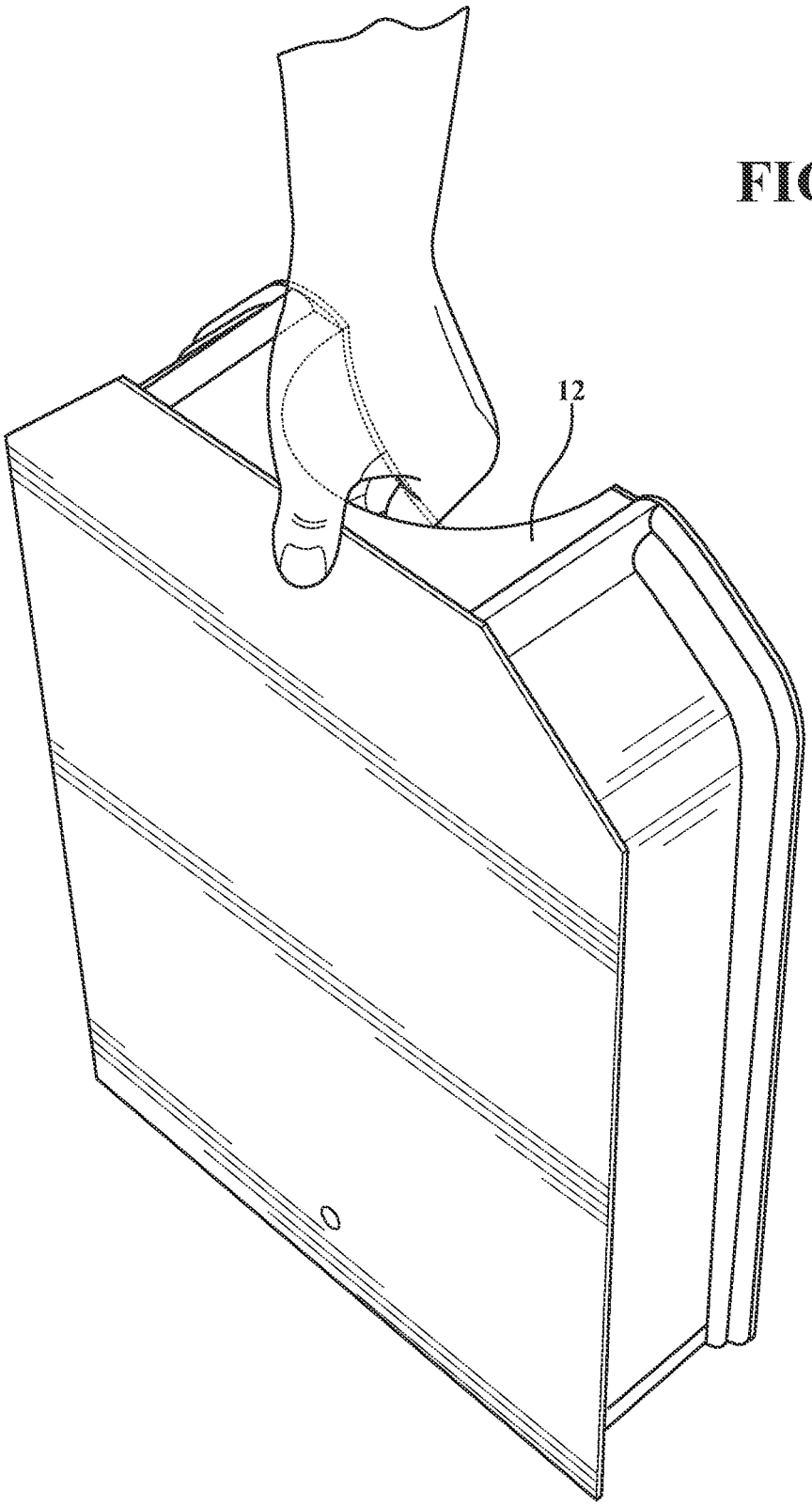
FIG. 8 shows the device of FIG. 1 being lifted by hand.

As shown in FIG. 7 a strip 34 of material may be added to reinforce the device around the top of the front hole opening 24 so that the device may be conveniently picked up by the hand as shown in FIG. 8.

Figure 9:
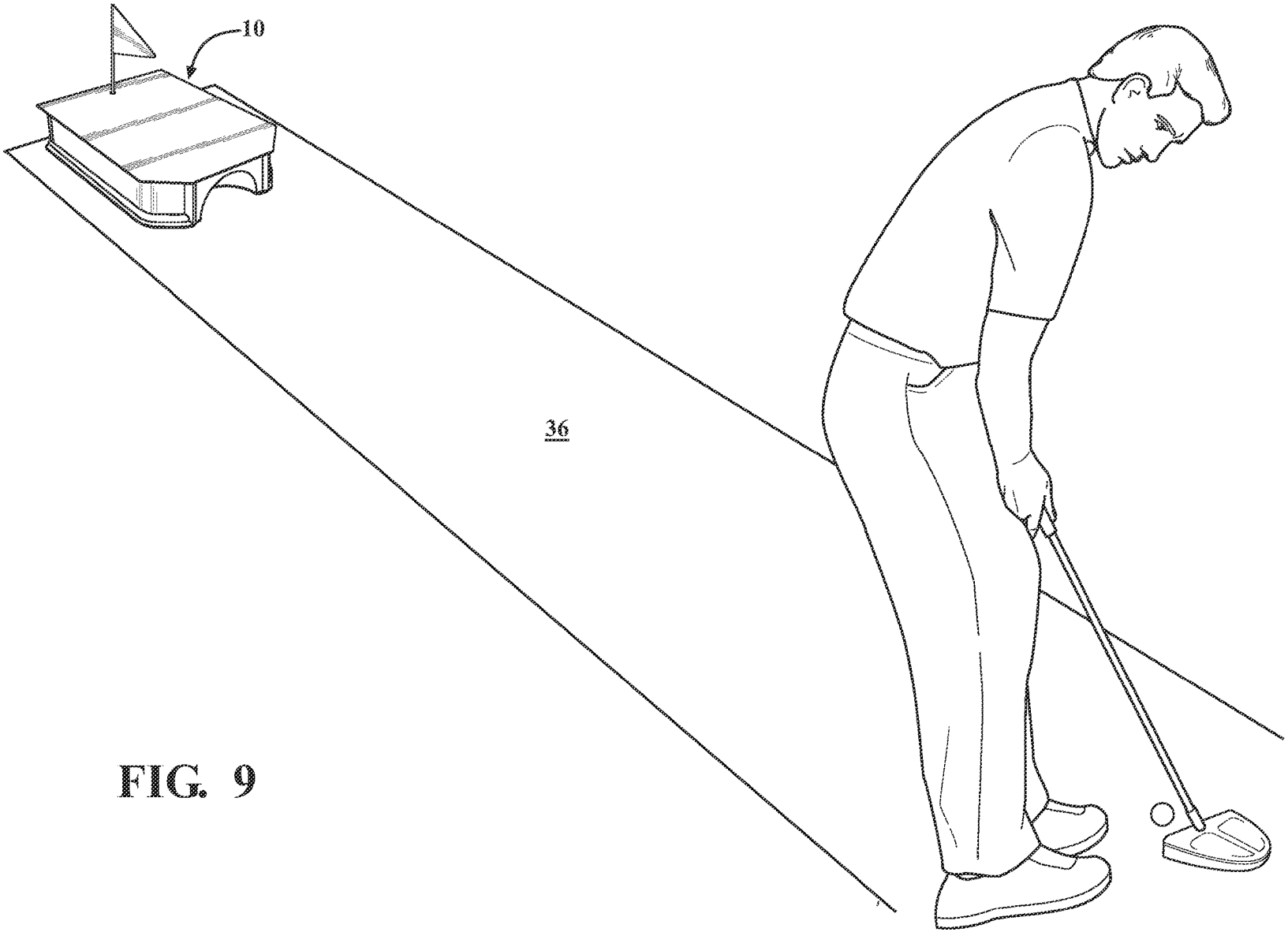
FIG. 9 is a perspective view of the illustrated device in use.

Referring now to FIG. 9, the device may be used by placing the flat bottom surface on one end of a flat strip 36 of artificial turf material with a very short nap to simulate the short cut grass of a regulation putting green and offer some but minimal resistance to the rolling motion of a regulation golf ball. The strip 36 may be marked with a series of distance markers such as 2, 3, 4 and 5 feet along a center line which runs to the center of the hole in the front center panel of the housing 10.

Dimensions which have been found satisfactory for the device are 13½ inches in depth, 9½ inches width (both measured along the top and bottom panels) and height of 3 inches. As previously described the diameter of the hole openings is exactly 4 inches and the radius is 2 inches whereby the two openings simulate a regulation golf hole.

Figure 4:
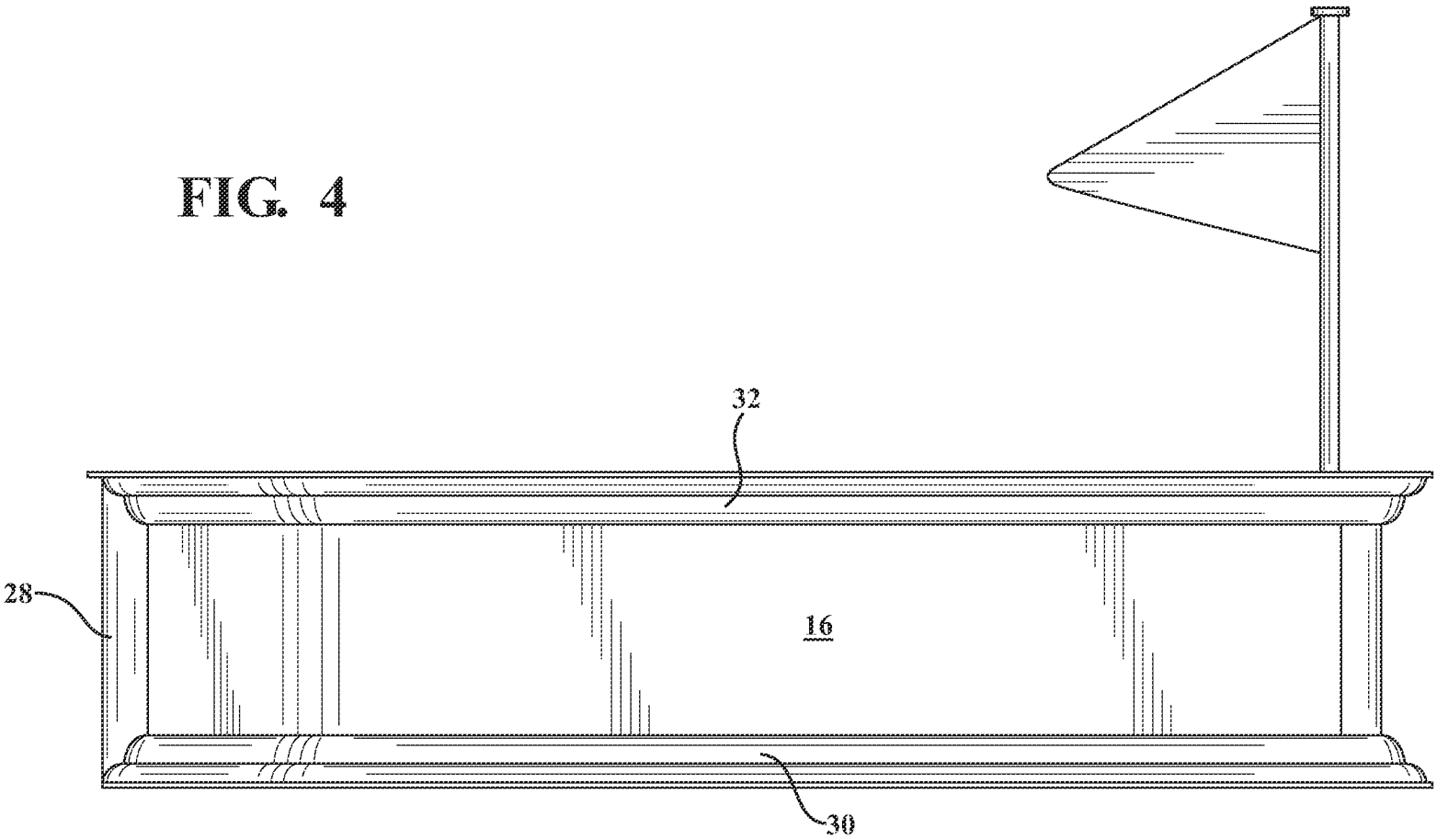
FIG. 4 is a right side view of the embodiment.
Figure 5:
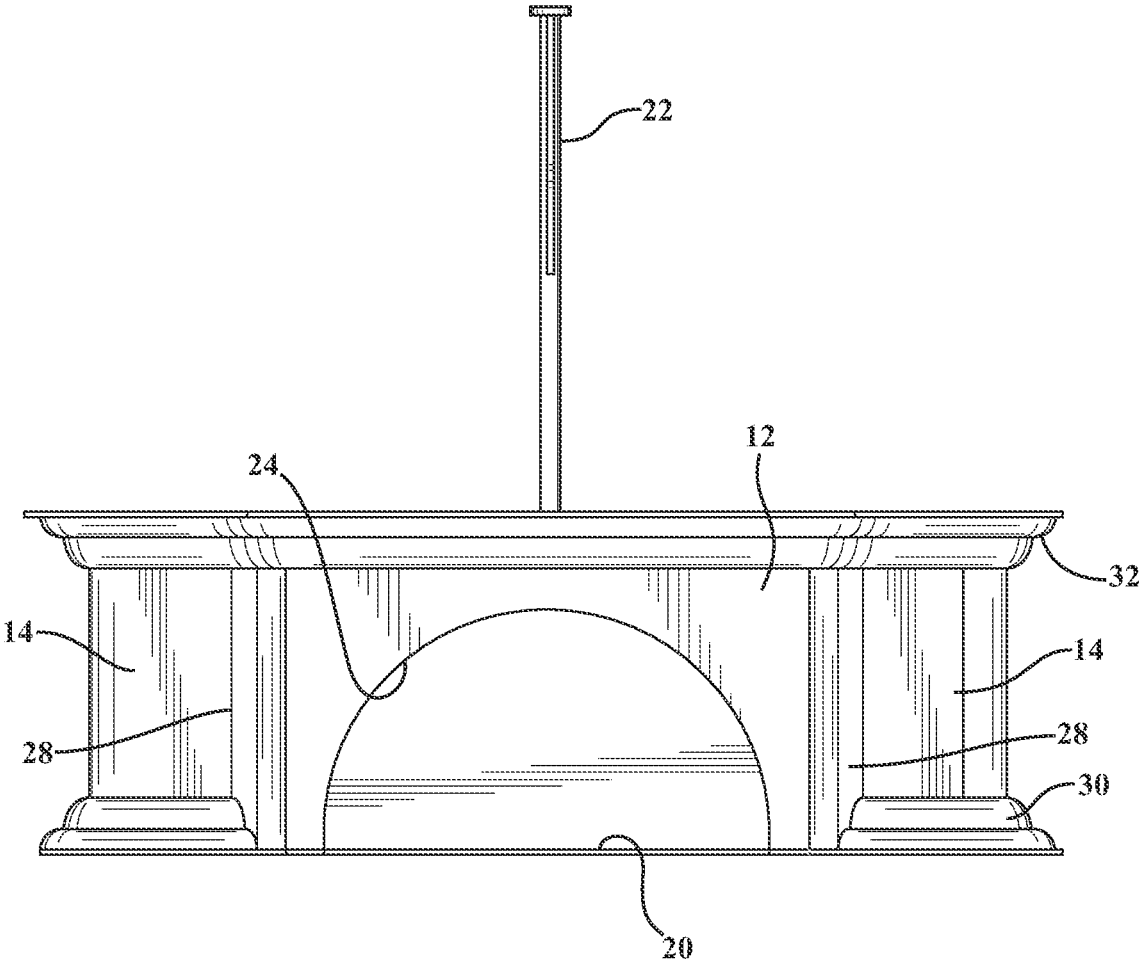
FIG. 5 is a front view of the embodiment.
Figure 6:
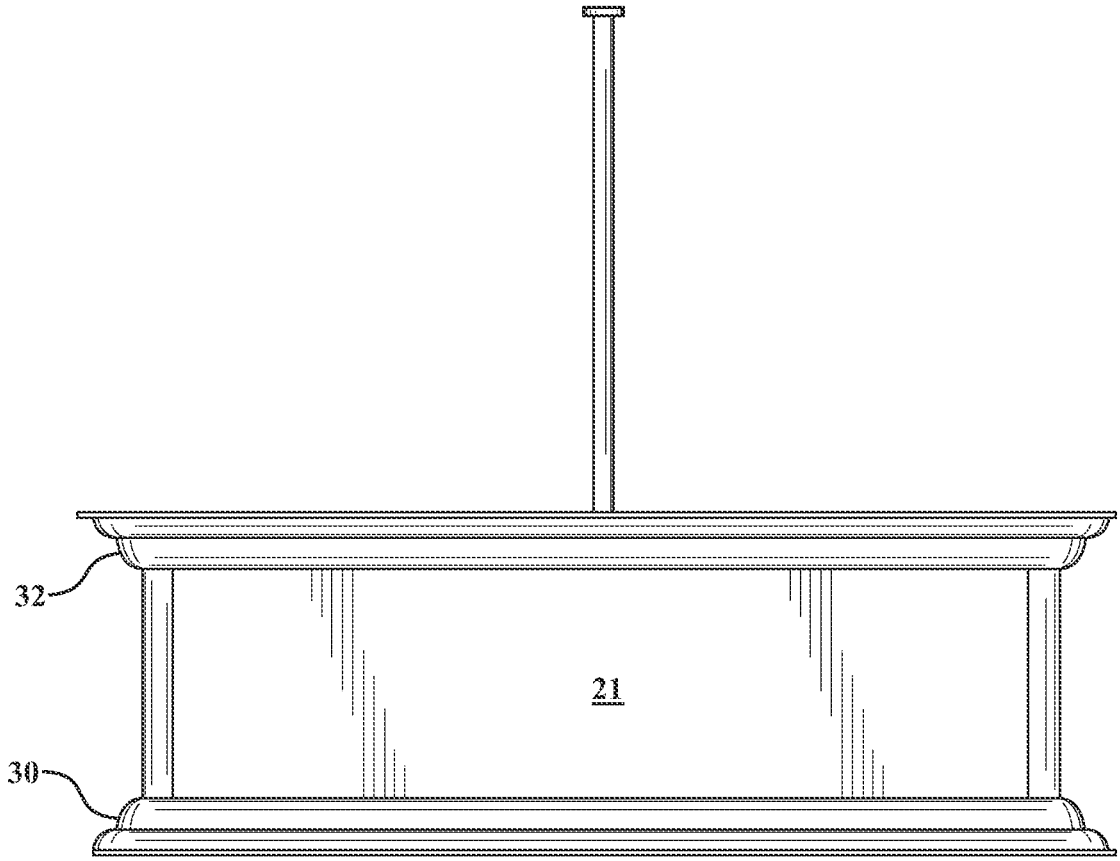
FIG. 6 is a rear view of the embodiment.

The housing is structured by giving the top and bottom panels equal overhangs as shown best in FIG. 4 so that the back or rear edges of the top and bottom panels lay in the same plane whereby the device may be stood on the back end for purposes of storage with a number of golf balls held in the interior of the housing 10.

The opening in the front center panel provides a convenient handle whereby one may insert one's fingers into the opening along the top edge thereof to lift the device with the bottom facing down and golf balls within the housing as shown in FIG. 8, thus, adding to the convenience of the device and encouraging more frequent use.

It will be understood that while the device has been described and illustrated with reference to a functional and aesthetically pleasing device, various modifications and additions to the device described herein may be made without departing from the fundamental concept behind the device and its innovative creation.

What is claimed is:

1. A putting practice device comprising:

a generally rectangular box structure having the integral combination of a flat bottom panel adapted to lie flat on a floor, a vertical front panel, opposite left and right side panels, a rear panel and a top panel;

the vertical front panel having formed centrally therein a semi-circular opening with a diameter co-located with said bottom panel to admit golf balls into the structure;

the flat bottom panel having a horizontal semi-circular opening formed therein of substantially the same size as the semi-circular opening in the vertical front panel and a diameter co-located with the diameter of the opening in the front panel, the semi-circular openings being aligned to create the appearance of a round golf hole.

2. A putting practice device comprising:

a generally rectangular housing having a flat bottom panel joined to a vertical front panel;

a semi-circular opening formed in said front panel with a diameter co-located with the plane of the bottom panel and a semi-circular opening in said bottom panel aligned with the opening in said front panel and with a diameter co-located with the diameter of the semi-circular opening in the front panel such that the openings create the appearance of a round golf hole to admit balls into an interior of the housing when said balls are directed toward said housing by a person practicing putting.

3. A putting practice device as defined in claim 2 wherein the housing further has a top panel, a rear panel and parallel side panels closing the housing and wherein the closed housing is of such size and volume as to accommodate therein a plurality of regulation size golf balls.

4. A putting practice device as defined in claim 3 wherein the rear panel is flat to allow the device to stand upright on the rear panel.

5. A putting practice device as defined in claim 3 wherein the front panel includes a center section with said semi-circular opening and left and right lateral sections respectively contiguous with said center section; said lateral sections being angled to deflect golf balls missing said semi-circular opening away from said housing.

* * * * *